US007010902B2

(12) United States Patent
Pagh

(10) Patent No.: US 7,010,902 B2
(45) Date of Patent: Mar. 14, 2006

(54) SYSTEM AND METHOD FOR CAPPING

(75) Inventor: Jens Pagh, Skurup (SE)

(73) Assignee: Trepak International AB, Malmo (SE)

( * ) Notice: Subject to any disclaimer, the term of this patent is extended or adjusted under 35 U.S.C. 154(b) by 0 days.

(21) Appl. No.: 10/504,734

(22) PCT Filed: Feb. 14, 2003

(86) PCT No.: PCT/SE03/00244

§ 371 (c)(1),
(2), (4) Date: Aug. 16, 2004

(87) PCT Pub. No.: WO03/070619

PCT Pub. Date: Aug. 28, 2003

(65) Prior Publication Data

US 2005/0144913 A1 Jul. 7, 2005

(30) Foreign Application Priority Data

Feb. 19, 2002 (SE) ..... 0200489

(51) Int. Cl.
*B65B 7/28* (2006.01)

(52) U.S. Cl. ..... 53/485; 53/309; 53/310; 53/311; 53/490; 53/484

(58) Field of Classification Search ..... 53/485, 53/490, 420, 410, 476, 484, 133.1, 128.1, 53/309–311, 287
See application file for complete search history.

(56) References Cited

U.S. PATENT DOCUMENTS 3,432,989 A * 3/1969 Bouzereau ..... 53/264
4,222,214 A 9/1980 Schultz et al.
4,312,172 A * 1/1982 Fisher et al. ..... 53/489
4,420,924 A * 12/1983 Hoyrup et al. ..... 53/307
4,938,649 A 7/1990 ter Horst et al.
5,115,617 A * 5/1992 Lewis et al. ..... 53/306
5,123,229 A 6/1992 Dardaine et al.
5,435,803 A * 7/1995 Owen et al. ..... 493/87
5,493,849 A * 2/1996 Itoh ..... 53/489
5,669,205 A * 9/1997 Rice et al. ..... 53/430
5,819,508 A * 10/1998 Kraft et al. ..... 53/492
5,964,687 A * 10/1999 Rogalski et al. ..... 493/102
6,044,626 A * 4/2000 Harper et al. ..... 53/490
6,341,472 B1 * 1/2002 Schroeder ..... 53/426
6,393,800 B1 * 5/2002 Schwenke ..... 53/329
6,701,692 B1 * 3/2004 Niehr ..... 53/167
6,834,478 B1 * 12/2004 Peronek et al. ..... 53/485
6,925,780 B1 * 8/2005 Anderson ..... 53/426

FOREIGN PATENT DOCUMENTS

EP 2487320 1/1982
EP 0316889 5/1989
EP 2699159 6/1994

* cited by examiner

*Primary Examiner*—Louis K. Huynh
*Assistant Examiner*—Gloria R. Weeks
(74) *Attorney, Agent, or Firm*—Ladas & Parry LLP

(57) ABSTRACT

A capping mechanism comprising an active feeder (20) device in which caps (1, 10) are fed actively forward arranged top-to-bottom along a feeding axis (30), and a hollow rotatable and linearly movable chuck device (40) arranged at the feeder's outlet end (22) and devised to grip a cap and mount said cap to a container opening. The feeder device preferably comprises movable members working in pairs (23, 24 and 25, 26 resp.) alternating to influence a row or pile of caps.

24 Claims, 9 Drawing Sheets

SYSTEM AND METHOD FOR CAPPING

FIELD OF THE INVENTION

The present invention relates to a mechanism for capping containers, and more particularly for a mechanism intended for applying screw-type caps on containers.

BACKGROUND

Commercial distribution and sale of viscous substances are as a rule performed with the substance in question contained in consumer adopted containers in the shape of cans, boxes, TetraPak®-type containers or bottles of different types. Most types of such containers are often in some way recloseable, e.g. by being provided with a lid for closing an opening in the container, or with a cap which can be tightly screwed to a threaded opening of the container and thereby sealing it. Different types of pourable substances that are packed in this way comprise beverages, oils, body and hair products, solvents, toners, corn flakes etc.

Consequently, capping is a frequently occurring procedure within the packaging industry, involving a cap being mounted to an opening in a container. This procedure is performed just after the moment when the containers are filled with their content, or at an earlier stage when the containers themselves are produced. A known method for capping of containers comprises the following steps, that generally are conducted in a repeated manner:

- A cap is fed forward laying on a band, standing or rolling in a conduit, in a chute or the like;
- A chuck picks the cap up, alternatively the cap is fed to the chuck;
- The chuck lifts the cap and brings it to the opening on a container;
- The chuck mounts the cap on the container, e.g. by pressure or by rotation.

Capped containers are often manufactured in very large volumes, and therefore great effort is often made to increase production pace. A problem with known capping methods is that they comprise a number of time consuming steps, limiting the capping pace. Such steps include the step of moving the chuck from a place where the cap is picked up, to the place where it mounts the cap on the container. Such steps also include the step of waiting for a new cap until the gravity has worked on said cap and caused it to fall into position for being picked up.

U.S. Pat. No. 4,222,214 to Schultz discloses a chucking apparatus for applying caps to a threaded portion of a container at a constant torque. In a representative embodiment, caps are supplied to the apparatus by an inclined chute under the influence of gravity to a cylindrical rotating hollow cap guide which guide caps and also conveys rotating power to a chuck device, said chuck device being mounted on a lower portion of the cap guide. Caps are thus center fed to the chuck device, which device comprises a plurality of jaw members, each of which members are pivotable to a cap gripping position. A resilient member is arranged to engage the jaw members in response to fluid pressure, causing the jaw members to pivot to the cap gripping position. The chuck device is subsequently rotated in order to screw the cap gripped thereby onto a container. The required movement of the chuck device is accomplished by lowering the chuck or raising the container or by a combination of both methods.

U.S. Pat. No. 1,824,660 to Darner discloses a mechanism for capping bottles, particularly milk bottles. In an embodiment the mechanism is central fed with caps of the press-on type. The caps form a pile inside the mechanism. The mechanism also comprises spiral rods, which, when the mechanism is pressed down, rotates, and sharp edges of cams mounted at the lower end of said spiral rods, separates the lowermost cap from the caps in the rest of the pile. Comprised are also plungers that will press the bottle cap down into a neck of the bottle.

U.S. Pat. No. 1,233,469 to Heath discloses a machine for applying caps. In one embodiment caps are applied to receptacle mouths and the machine is spinning or curling the same thereon by means of a rotary cap spinning or curling device. The caps are arranged in a vertical stack or column feeding downwardly by gravity through a head of the machine and aligned with an axis of rotation of said spinning device.

U.S. Pat. No. 982,231 to Barry discloses a bottle capping machine of a manual lever-operated type, comprising a magazine tube, a receptacle holder and a capping device mounted on a carrier.

U.S. Pat. No. 1495,283 to Chulin et al discloses a screw-lid fitting device for jars comprising a lid receiver with folding flap at top of hollow chuck with lid stops round bottom. When the chuck comes down, upper arms of twin-arm levers disengage from endface of a cylinder. A spring pulls the lower arms of said levers towards each other, gripping the lid and unscrews/screws the lid as the chuck rotates.

An object of the present invention is to provide a capping mechanism capable of providing an increased capping rate compared to the prior art techniques. Furthermore, it is an object to provide a capping mechanism which can be used for various different sorts of containers and caps.

SUMMARY OF THE INVENTION

According to a first aspect, the objects according to the above are fulfilled by a capping mechanism, comprising an active feeder device having means for actively feeding caps forward arranged top-to-bottom along a feeding axis, and a chuck at an outlet end of the feeder, arranged to grip a cap and mount said cap to a container opening. Preferably, said means for actively feeding caps are devised to diametrically engage with a cap present in the feeder device, and to move the cap forward along the feeding axis during engagement.

In one embodiment, said feeder device comprises elongated feeder members movable in pairs relative to each other and arranged to alternately hold and release caps arranged between two members in a pair, thereby feeding said caps forward during a hold and move action of at least one pair of said members. Said chuck preferably has a central passage and comprises two or more adjustable chuck jaws arranged to hold the cap during a mounting act.

The feeder members preferably comprises two pairs of feeder jaws, each jaw of each said feeder jaw pair being moveable towards the other jaw, wherein one pair of jaws also is moveable in a direction parallel to the feeding axis.

According to a second aspect, the objects according to the above are fulfilled by a feeder device for a capping machine, which capping machine comprises a chuck arranged to grip a cap and mount said cap to a container opening, which feeder device comprises means for actively feeding caps forward arranged top-to-bottom along a feeding axis, to an outlet end proximal to the chuck. Preferably, said means for are actively feeding caps are devised to diametrically engage with a cap present in the feeder device, and to move the cap forward along the feeding axis during engagement. In one embodiment said feeder device comprises elongated feeder members movable in pairs relative to each other and arranged to alternately hold and release caps arranged between two members in a pair, thereby feeding said caps forward during a hold and move action of at least one pair of said members.

According to a third aspect, the objects according to the above are fulfilled by a method for feeding caps in a container capping machine, comprising the steps of:

supplying a cap to a feeder device;

engaging the cap diametrically;

feeding the cap, under engagement, along a feeding axis to an outlet position.

According to a fourth aspect, the objects according to the above are fulfilled by a capping mechanism, comprising an feeder device for feeding a cap forward, with a bottom of the cap facing a feeding axis, from an inlet position to an outlet position of said feeder device, and a chuck devised to receive a cap from a first side of said chuck at said outlet position, and to mount said cap to a container opening at a second side of said chuck, opposite said first side along said feeding axis, wherein said feeder device is devised to actively feed a cap to said outlet position.

Preferably, said feeder device comprises means for engaging about a first portion of a circumference of a cap present in the feeder device, and means for moving the cap forward along the feeding axis to said outlet position during engagement.

In one embodiment, said chuck comprises means for engaging about a second portion, different from said first portion, of said circumference when said cap is present in said outlet position.

Preferably, said first portion covers substantially diametrically opposing areas of the circumference of the cap.

In a preferred embodiment, said feeder device comprises first and second gripping jaws, devised to engage a cap in said inlet position by gripping substantially diametrically opposing areas of the circumference of the cap, and means for moving said gripping jaws along said feeding axis.

In one embodiment, cap supply means are devised to supply caps one by one to the inlet position of said feeder device. Said cap supply means are preferably devised to supply caps to the inlet position in a supply direction which has an angle to said feeding axis. In a more specific embodiment, said cap supply means are devised to supply caps to the inlet position in a supply direction which is substantially perpendicular to said feeding axis. Preferably, said cap supply means are devised to supply caps arranged side-by-side along said supply direction to the inlet position.

In a preferred embodiment, said feeder device comprises elongated feeder members movable in pairs relative to each other and arranged to alternately hold and release a cap arranged between two members in a pair, thereby feeding said cap forward during a hold and move action of at least one pair of said members.

More specifically, in such an embodiment said feeder members may be devised to grip and move two or more caps at a time, which caps are successively supplied to said inlet position and fed top-to-bottom by said feeder members to said outlet position.

According to a fifth aspect, the objects according to the above are fulfilled by a method for capping containers, comprising the steps of:

supplying a cap to an inlet position of a feeder device such that said cap is arranged with a bottom of the cap facing a feeding axis;

gripping the cap by means of the feeder device engaging about a first portion of a circumference of the cap;

feeding the cap, under engagement, along said feeding axis to an outlet position;

receiving the cap from a first side of a chuck at said outlet position;

gripping the cap by said chuck; and mounting the cap to a container opening at a second side of said chuck, opposite said first side along said feeding axis.

Preferably, said chuck grips said cap by engaging about a second portion, different from said first portion, of said circumference.

Furthermore, said first portion preferably covers substantially diametrically opposing areas of the circumference of the cap.

According to a sixth aspect, the objects according to the above are fulfilled by a method for feeding caps in a container capping machine, comprising the steps of:

supplying a first and a second cap to a feeder device, wherein said caps are arranged top to bottom;

engaging the caps diametrically;

feeding the caps, under engagement, along a feeding axis until the first cap reaches an outlet position;

gripping the first cap in the outlet position with a chuck;

removing the first cap from the outlet position by said chuck; and feeding the second cap, under engagement, along the feeding axis until it reaches the outlet position.

BRIEF DESCRIPTION OF THE DRAWINGS

The present invention, including further features, aspects and advantages will become better understood from the following description with reference to the accompanying drawings, on which.

DETAILED DESCRIPTION OF PREFERRED EMBODIMENTS

Figure 1:
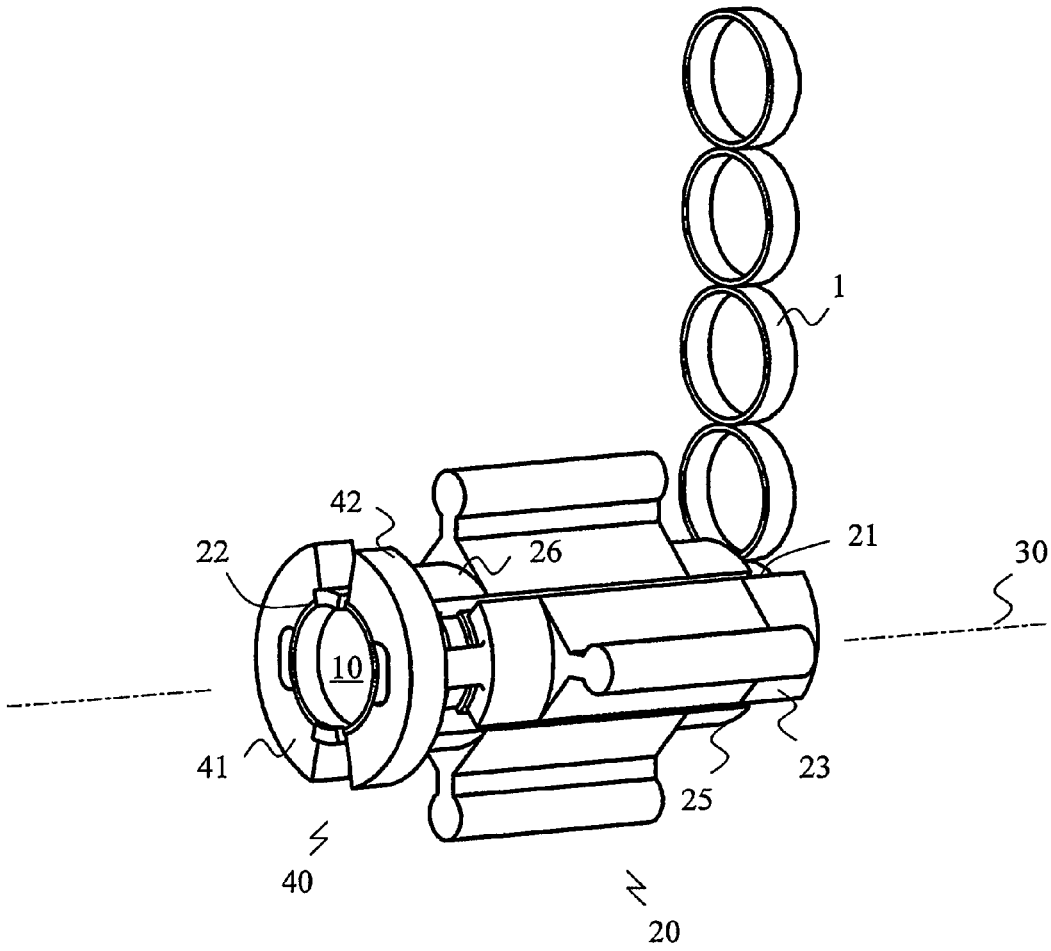
FIG. 1 shows a capping mechanism according to a first embodiment of the present invention.
Figure 2:
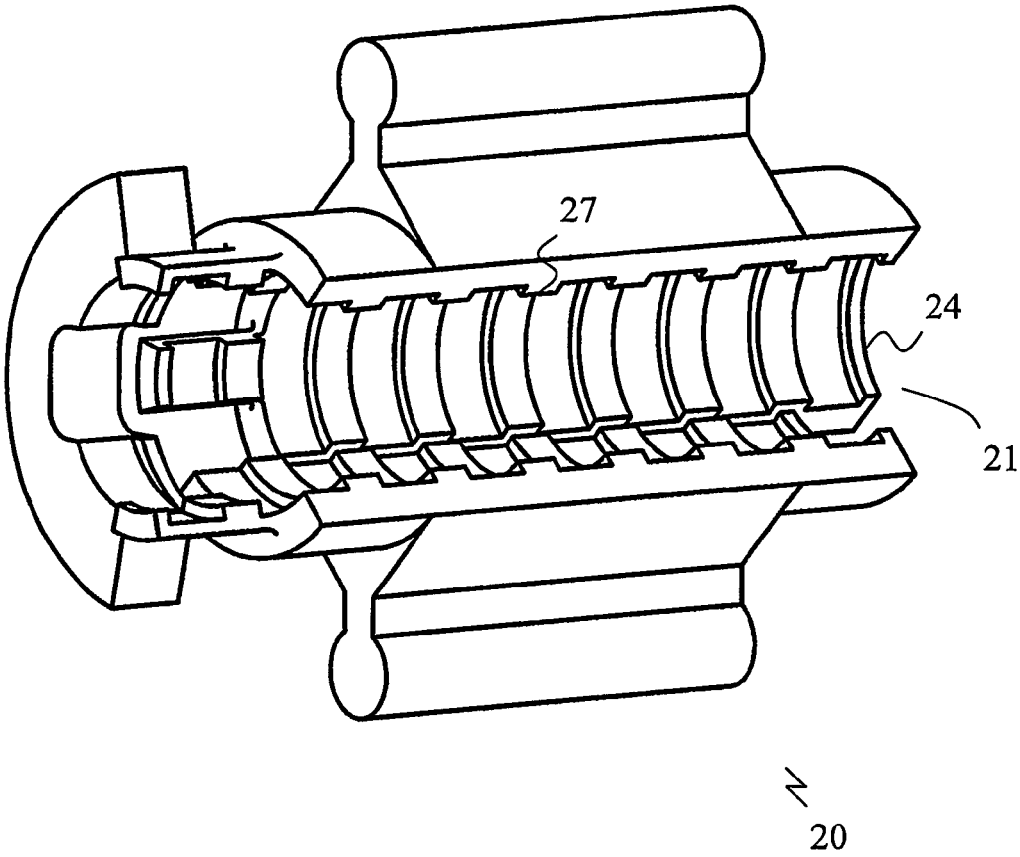
FIG. 2 shows a detail of a feeder device of the mechanism in FIG. 1, with one feeding jaw removed for enhanced clarity.

FIGS. 1 to 4 illustrate a first embodiment of the present invention. Referring to FIG. 1, caps 1 are supplied from above, oriented with the bottom (inside) facing left, side to side after each other, to an inlet opening 21 of a feeder device 20. The caps 1 are placed in a feeder device 20 in an inlet position 21. From this inlet position 21 caps are fed forward (left in the drawing) by the device 20, in a piled arrangement in a pipeline kind of process. A piled arrangement is not necessarily a vertical pile, it means rather that the caps 1 are arranged top-to-bottom, i.e. the bottom of one cap faces the top of the preceding cap, according to the drawings. Furthermore, the caps are conveyed through the feeder with the bottom facing the direction of transportation. The feeder device 20 is also provided with an outlet end 22. A feeder mechanism 23–26 is provided within the feeder device 20, devised to actively feed caps from the inlet end 21 all the way to the outlet end 22 in a controllable pace. This feeder mechanism functions by actively gripping each cap present therein, preferably diametrically, and then displacing the cap by moving the gripping point towards the outlet end 22. In one embodiment the feeding device comprises means for bringing caps forward with the help of a helical movement. This can be achieved by arranging two or more rotatable shafts parallel to the feeding axis 30 and spaced from each other such that they engage a cap present there between. The shafts can be provided with threads or the like, such that rotation of the shafts will result in the caps being forced forward in the feeding direction. In another embodiment the feeding may be provided by endless belts engaging diametrically opposite sides of a cap, and running in the feeding direction.

Figure 4:
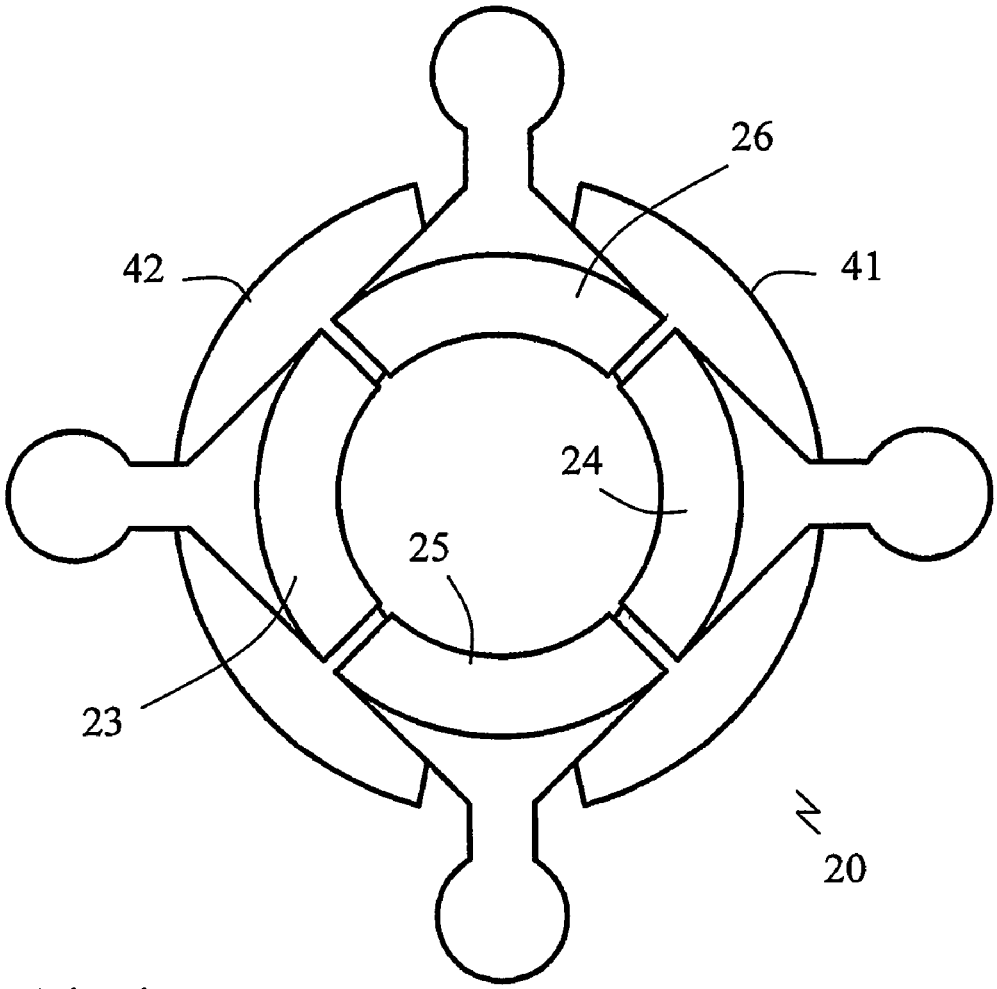
FIG. 4 shows the embodiment of FIG. 1 from the side.

In the shown embodiment, however, said feeder device 20 comprises two pairs of members in the form of feeding jaws. A first pair 23, 24 (24 not shown in FIG. 1) and a second pair 25, 26, respectively. In this embodiment, each pair of feeding jaws is arranged to grip caps present there between, preferably with a grip where said jaws make contact on diametrically opposite sides of caps. The first pair is also shiftable back and forward in the direction of a feeding axis 30. The two pairs of feeding jaws are arranged approximately 90° in relation to each other around the feeding axis 30. FIG. 4 illustrates, as seen from the inlet end 21, the arrangement of the feeding jaws 23–26 about the feeding axis 30. The feeding jaws grip and release by relative displacement towards and away from each other, respectively. Said jaws can grip and hold caps with the mere use of friction force, but preferably utilises a number of lugs 27 arranged for this purpose. The lugs are arranged at equidistant positions along the feeding device 20, the distance between which is selected to fit the cap size in question. These lugs 27 will correct minor errors in alignment of the caps and prevent them from jamming the feeder device 20.

The shown embodiment is devised to feed caps according to the following general principle:

- The first pair of feeding jaws 23, 24 grips the caps in the feeder including the one in the inlet position, while the second pair of feeding jaws 25, 26 subsequently releases their grip around the caps in the feeder 20;
- The first pair of feeding jaws 23, 24 moves forward, bringing the caps forward one positional step in the feeder along the feeder axis towards the outlet end 22;
- The second pair of feeding jaws 25, 26 grips the caps in the feeder, and subsequently the first pairs of feeding jaws 23, 24 releases its grip around the caps;
- The first pair of feeding jaws 23, 24 is brought back along the feeding axis to enable said jaws 23, 24 to stand by for gripping the caps and make the next cap in the inlet position 21 part of the piled arrangement of caps in said feeder.

A cap 10 that has reached the outlet end 22 is solely held by the second pair of feeding jaws 25, 26, and is still turned so that its bottom side preferably is facing outwards from the outlet end 22. With bottom side is meant the side that is to be mounted to a container opening. FIG. 1 further illustrates how a chuck 40 is arranged at the output end 22, and provided with a central passage for the caps. The chuck preferably comprises at least two chuck jaws 41, 42 movable in a radial direction and said chuck jaws are so devised that they can grip the cap 10 at the same time as said cap is gripped by the second pair of feeding jaws 25, 26 according to the drawing. The chuck 40 is furthermore devised to rotate, for the purpose of fixing it to a container opening. For this rotation the chuck is driven by a suitable transmission of a drive motor (not shown). FIG. 1 shows the feeder device 20 in a position subsequent to the last of the aforementioned steps. When the first pair 23,24 of feeding jaws is brought back, opposite the feeding direction, the chuck 40 is displaced in the same direction along the axis 30, to a position radially outwardly of the cap 10 held by the second feeding pair 25,26 in the outlet end 22. Once in the position outside the cap 10, the chuck 40 grips the cap 10 by a relative inward displacement of the chuck jaws 41,42 towards the axis 30, thereby assuming the position shown in FIG. 1. When the chuck has gripped the cap 10 the second pair of feeding jaws 25, 26 are moved outwardly releasing their grip around the cap. This step also forms a part of the feeding procedure described above. The drive motor mentioned above is preferably a servo drive motor capable of bringing the chuck 40 to an angular position that makes room for the second pair of feeding jaws 25, 26 in the gaps between the chuck jaws 41,42, when the chuck returns to fetch the next cap fed to the outlet end 22.

Figure 3:
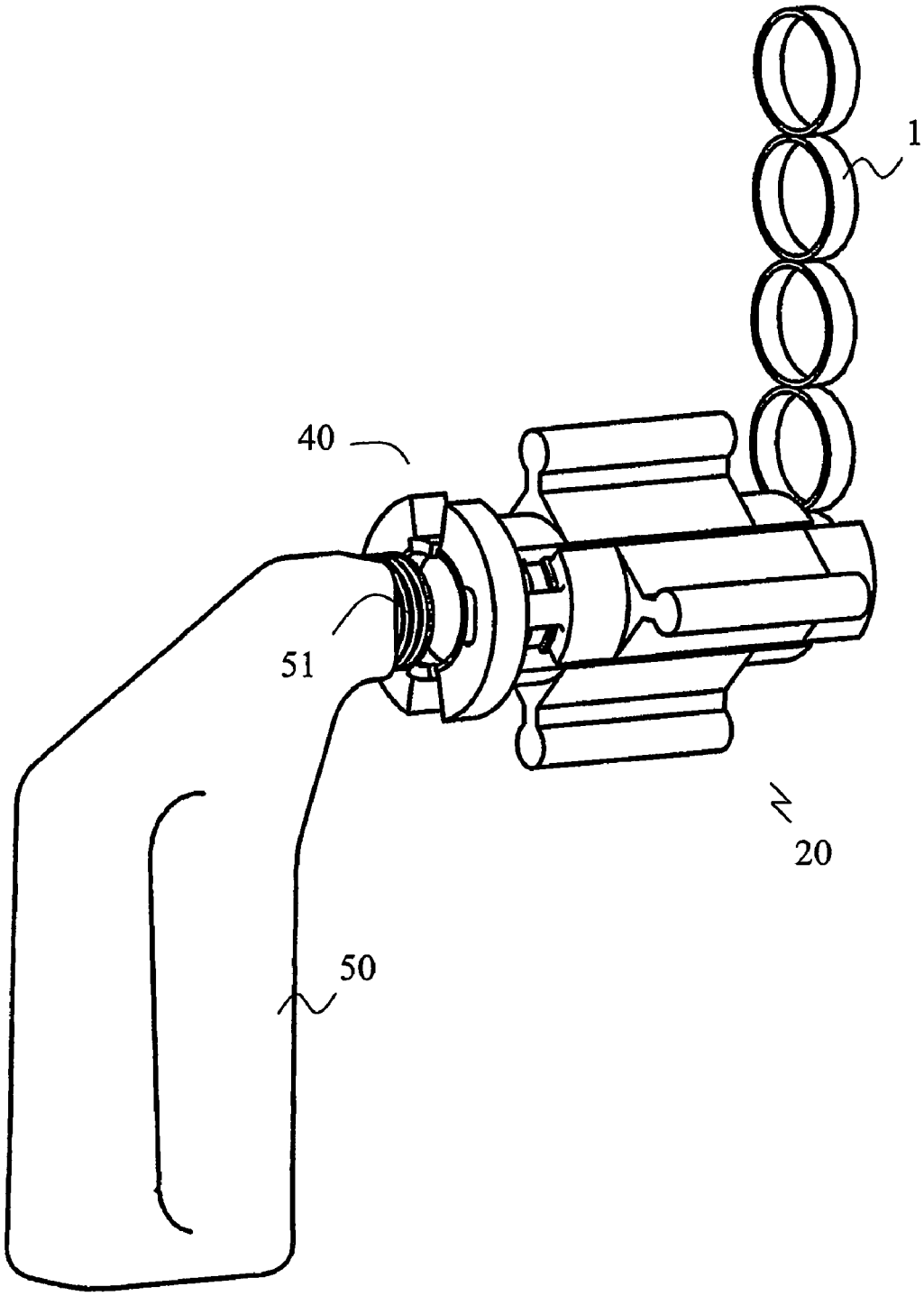
FIG. 3 shows the mechanism of FIG. 1 together with a container.

FIG. 3 illustrates the mounting of a cap 10 to a container 50, by means of the chuck 40. The container 50 is arranged with an opening 51 in close proximity to, and in alignment with, the outlet end 22 and axis 30. This is advantageous because the chuck 40 then only has to move the cap a minimum distance from the outlet end 22 towards the container opening 51, clearing it from the outlet end position to which a new cap is fed. This distance is completely one-dimensional and aligned with the feeding axis 30. The power for this linear motion may come from a linear motor, or from a suitable deflection of power from the rotation drive motor. The radial motion of the chuck jaws 41,42 can for example be produced by way of linear motors or pneumatics, in a manner well known to the skilled person.

The chuck 40 is brought into a position so that during the mounting of the cap, said chuck can rotate freely from the pair of feeding jaws 23, 24 and 25, 26, at the same time as room has been left at the outlet end 22 at an outlet position in the second pair of feeding jaws 25, 26, for a new cap to be fed forward to the outlet end 22. After a completed mounting the chuck is brought back to the position shown in FIG. 3, and said chuck is able to repeat the described process for the next cap that has been brought into place ready to be fed to the chuck. A new container is in that connection preferably fed forward to the position shown in FIG. 3.

Figure 5:
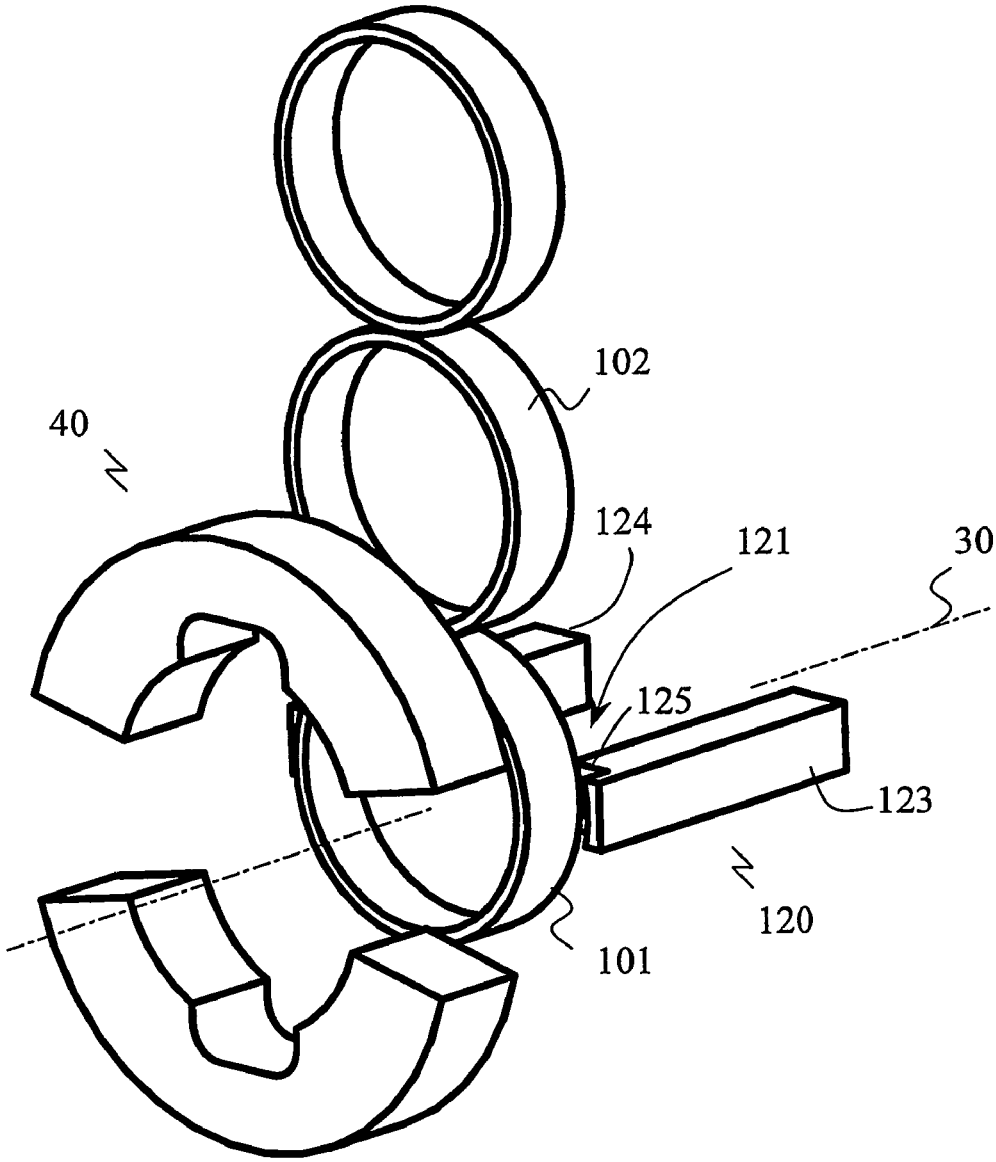
FIGS. 5–9 schematically illustrate a second embodiment of a capping mechanism according to the invention, and different method steps of a capping process according to this embodiment of the invention.

FIGS. 5 to 9 illustrate a second embodiment of the present invention. In this embodiment, the feeder device is of a simpler design than in the previous drawings. In this embodiment, caps are supplied from above, oriented with the bottom (inside) facing left, side to side after each other, to an inlet position 121 of feeder device 120. The caps are e.g. supplied from a chute (not shown). In FIG. 5 a first cap 101 is placed in the inlet position 121. From this inlet position 121, cap 101 is subsequently fed forward (left in the drawing) by the device 120 to a chuck 40, with the bottom of said cap 101 facing the direction of transportation. A feeder mechanism 123,124 is provided within the feeder device 120, devised to actively feed caps from the inlet position 21 to an outlet position 122, at which outlet position said chuck grabs the cap. This feeder mechanism functions by actively gripping each cap present therein, preferably diametrically, and then displacing the cap by moving the gripping point towards the outlet position or end 122. In the embodiment of FIGS. 5 to 9, the feeder mechanism of said feeder device 120 comprises a pair of gripping members or jaws 123,124. The pair of gripping members are arranged to grip a cap present there between on diametrically opposite sides of the cap. As is illustrated in FIG. 5, a front end portion of each gripping member is devised with a shoulder-like gripping portion 125 facing the other gripping member. In the drawing, only the gripping portion 125 of the first gripping member 123 is clearly shown, but it should be noted that the second gripping member 124 has a corresponding structure facing gripping member 123. Cooperating gripping portions 125 are devised support a cap placed in the inlet position 121 by means of the shoulders of the gripping members, such that the cap will not twist but rather assume a position with its bottom facing the feeding axis 30. The gripping portions may optionally include further support structures, not only devised to support side and top portions of the cap, but also a front portion. For instance, the gripping portion 125 may include a recessed portion in the respective gripping member, providing shoulder edges both towards the top and bottom of a cap present between the gripping members. With such a solution, the gripping members must be capable of moving apart to an extent where the cap can be released forward along the feeding axis, when the cap has been fed to and gripped by the chuck, according to FIG. 8 described in more detail below. Alternatively, the capping mechanism may include a separate forward stopping member devised to prevent a cap supplied to the inlet position 121 to fall forward, which separate forward stopping member is withdrawn once the gripping members have engaged and gripped the cap.

FIG. 5 illustrates a starting position, in which the first cap 101 is positioned in the inlet position 121. A cap stopping member is preferably arranged below the first cap 101, if the device is oriented as illustrated, such that the first cap 101 rests towards said cap stopping member. The gripping jaws 123,124 are located at a distance or an angle from each other, such that the distance between gripping portions 125 is larger than the diameter of cap 101. Preferably, the next cap 102 is does not rest on the first cap 101, but is rather fixed in the illustrated position by cap locking means (not shown). The third cap 103, and possibly further caps above the third, are rested one on the other, on the second cap 102. The gripping jaws and the first cap 101 are placed behind chuck 40.

Figure 6:
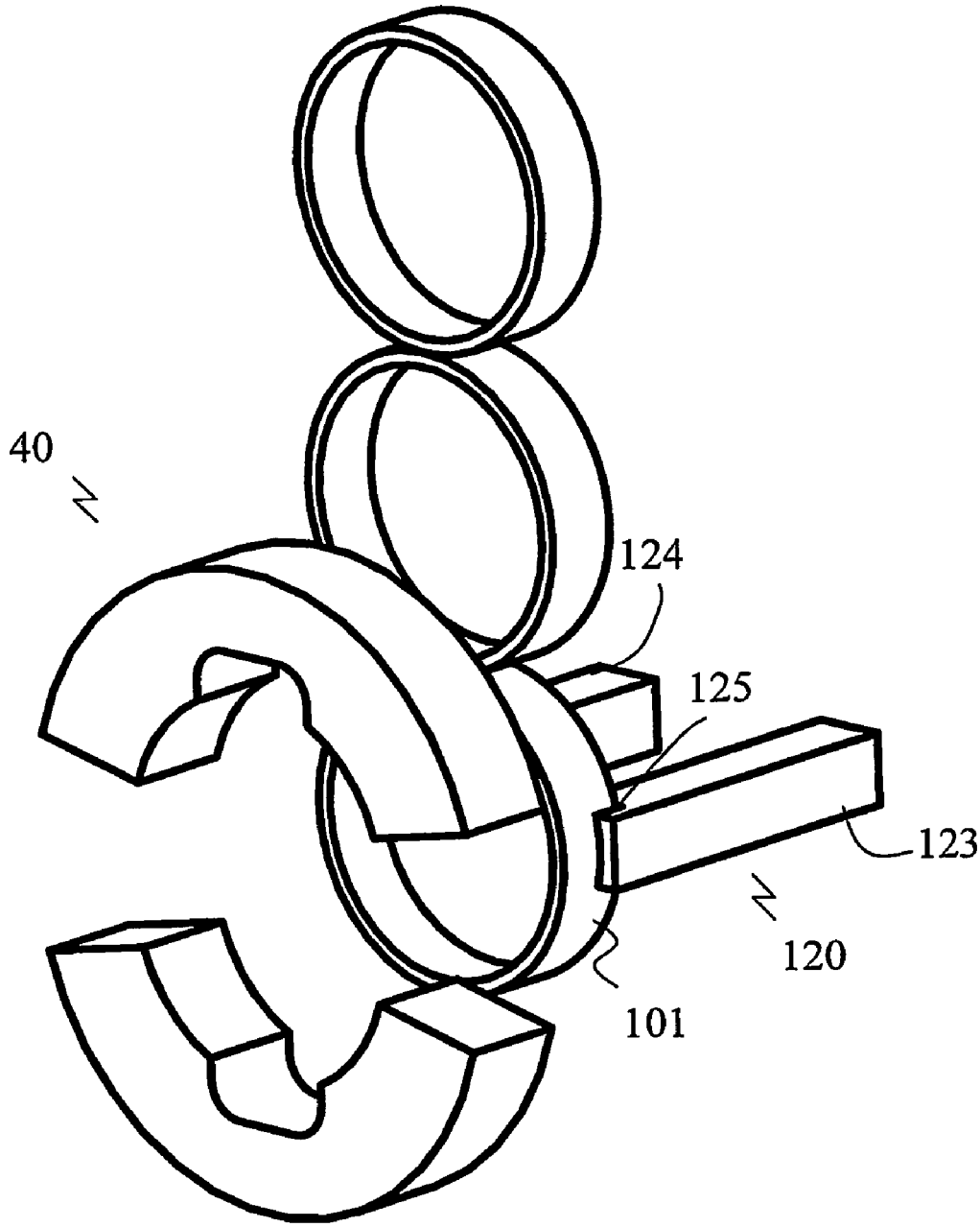

FIG. 6 illustrates a second position, in which the gripping jaws have been placed in diametrical contact with the cap 101. This is achieved either by displacing the gripping jaws towards each other, or by pivoting them, such that the gripping portions 125 are brought closer to each other.

Figure 7:
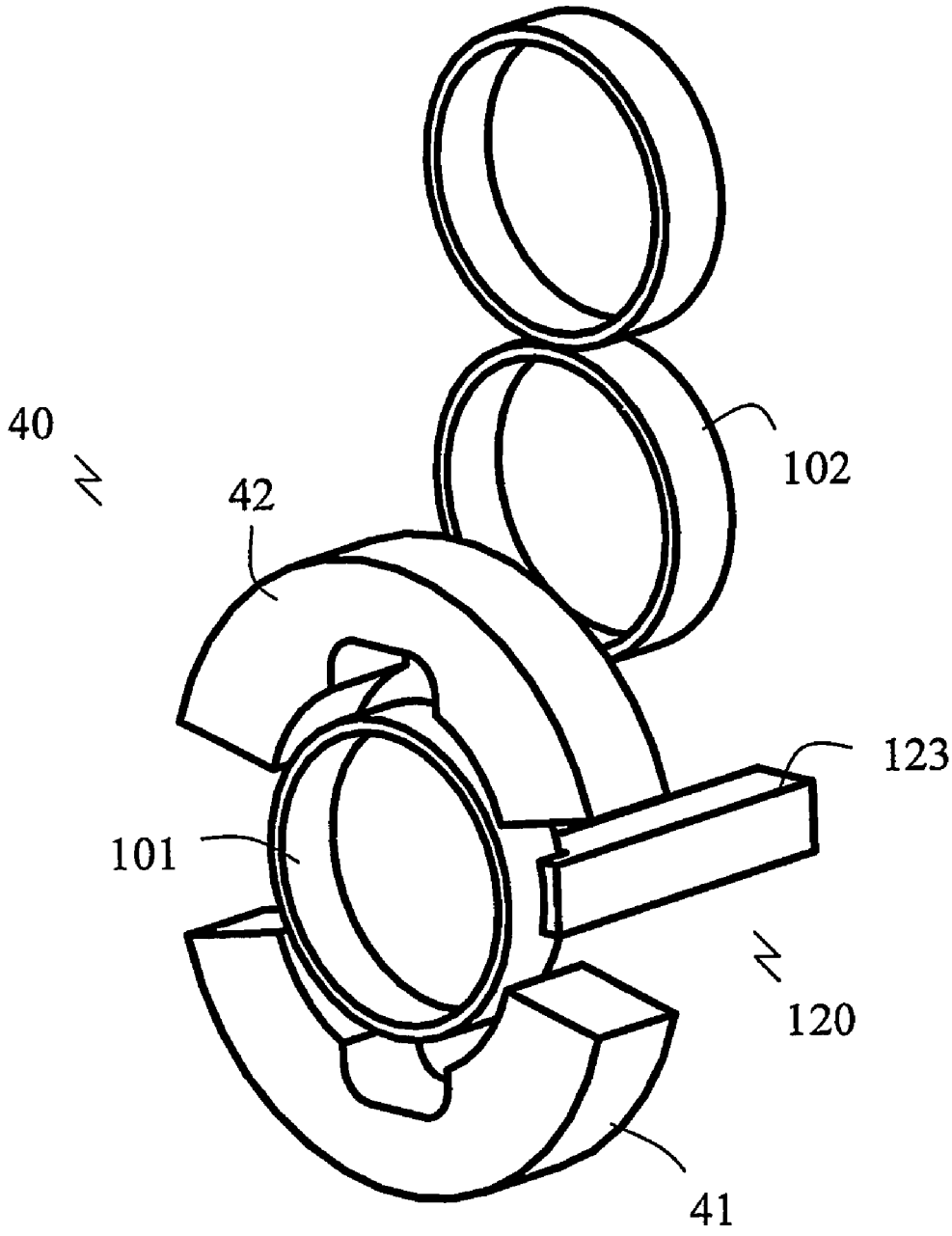

FIG. 7 illustrates how the feeder device 120 has been displaced forward towards the chuck, such that the first cap 101 has been brought into an outlet position of the feeder device where it is to be handed over to the chuck. As indicated before, the second cap 102 is maintained in the previous position by cap locking means. As mentioned, the gripping jaws 123,124 of the feeder device 120 are diametrically arranged in relation to a cap positioned there between. Furthermore, as is also illustrated in the drawings, the gripping portions 125 of the gripping jaws each cover only a first portion of the circumference of the cap. The chuck, on the other hand, comprises at least two chuck jaws 41, 42 which are displaceable in a radial direction from a centre feeding axis 30, see FIG. 5. These chuck jaws each cover a second portion of the circumference of the cap. The first and second portions of the circumference are complementary, and together they cover, at most, the entire circumference, though preferably less. Furthermore, when the capping mechanism is arranged in the position as shown in FIG. 7, the chuck jaws are rotatably oriented such that the gripping jaws 123,124 and the chuck jaws 41,42 face different portions of the circumference of the cap. This way, both the gripping jaws 123,124 and the chuck jaws 41,42 are capable of gripping the cap, preferably perpendicularly in relation to each other.

Figure 8:
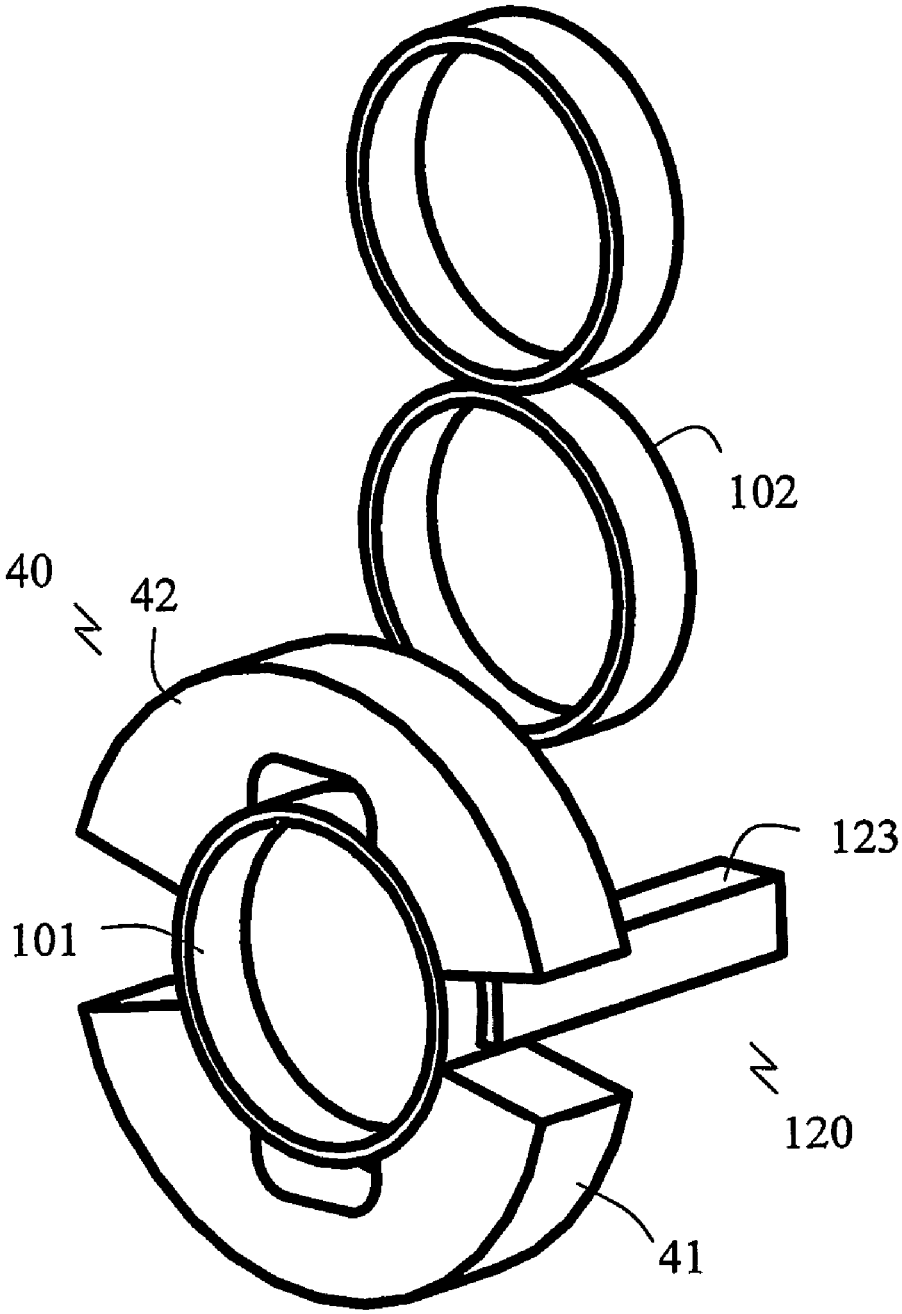

FIG. 8 illustrates how the chuck jaws 41,42 have been displaced radially inwards, to grip the first cap 101. Once the cap 101 has been gripped by the chuck jaws, the gripping jaws 123,124 of the feeder device 120 release their grip of the cap, and the gripping jaws are brought back to the position shown in FIG. 5.

Figure 9:
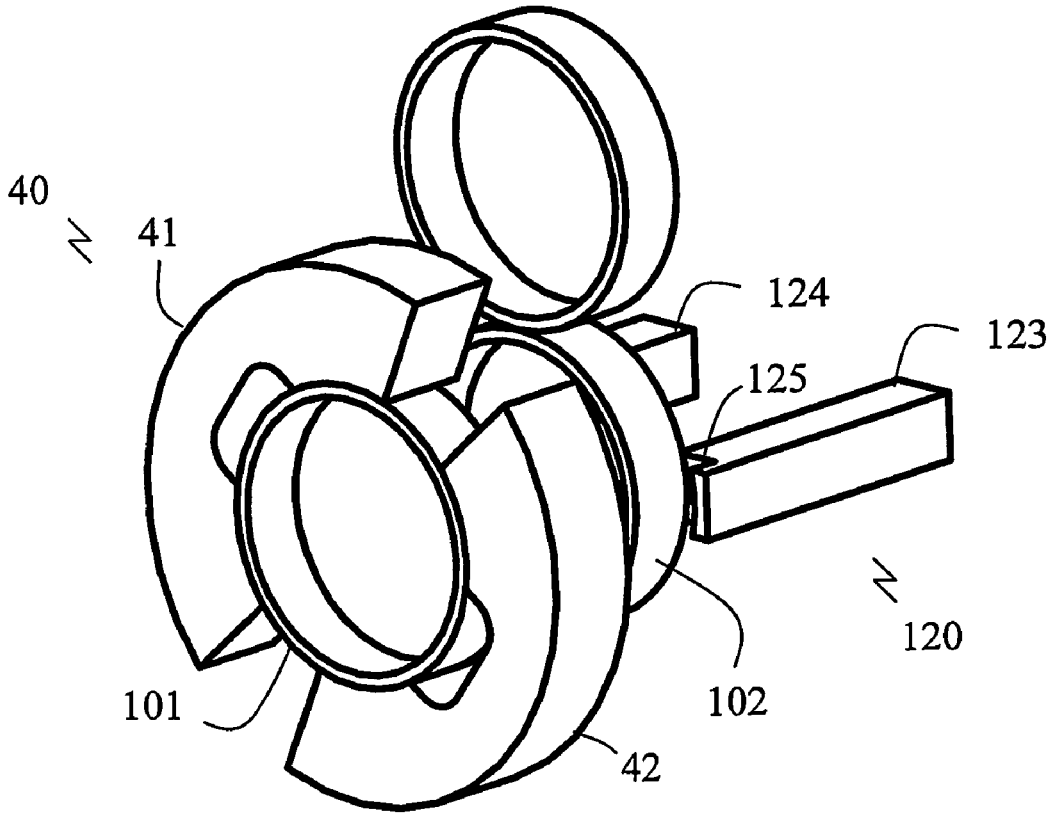

FIG. 9 illustrates application of the cap on a container opening (not shown). The cap 101 is applied by rotation of chuck 40. At the same time, the chuck is preferably displaced forward towards the container opening at a rate corresponding to the pitch of cooperating threads on the inside of the cap and on the outside of the container opening, respectively, such that the container opening can be maintained in a substantially fixed position during application of the cap. In a preferred embodiment, rotation of chuck 40 also unlocks the cap locking means, such that the subsequent cap 102 enters the inlet position 121. When the first cap 101 has been applied, chuck 40 returns the position of FIG. 6, preferably by first releasing its grip of the first cap 101, thereafter by rotating to the perpendicular orientation in relation to the gripping jaws 123,124, and finally by a backwards linear translation. The capping mechanism is then returned to the state illustrated in FIG. 5, and the process is thereafter preferably repeated, including the steps of removing the capped container opening and placing a new container opening in front of chuck 40.

Several advantages are achieved with the present invention. It should be noted that many of the above actions performed by the participating parts can take place simultaneously, forming an efficient pipeline, or assembly-line way of operation of the capping mechanism, enabling a high capping pace. The feeding and the transport in the chuck of the cap take place in one and the same dimension, which results in a simple and thereby fail-safe process. Moreover, the displacement of the chuck 40 is very short, in the described embodiment basically not longer than the height of a cap or the pitch of the threaded portion of the cap, which enables an increased pace of capping compared to a solution in which the cap has to be picked up by the chuck and be transported sideways, compared to axis 30, to the container opening 51. The feature of feeding the caps top-to-bottom also enables, in most cases, a more compact design of the capping machine including the feeding device.

A technical effect of the present invention is that the feeding of caps does not rely on gravity. The supply of caps to the feeder device may rely on gravity, but may alternatively be achieved by actively supplying the caps by force to the feeder device. This means that the feeding apparatus, combined with a chuck, can be used for applying caps in any direction. It is well known that there are several types of containers which have side-mounted openings, e.g. the type illustrated in FIG. 3, suitable for water closet cleaning fluids. This type of container cannot be capped by any of the aforementioned gravity-dependent solutions of the prior art. The use of gravity feeding further has the disadvantage that flat caps tend to jam in a feeding pipe if they are dropped top to bottom. Furthermore, some types of caps are conical, such that the top of one cap fits into the bottom of another cap. Both the weight of the caps and the fact that they are repeatedly dropped and halted, may cause them to engage and catch on to each other when arranged piled top to bottom.

In the shown embodiment, the cap is mounted by rotation into threaded engagement with the container opening 51. However, it could of course also be advantageous to use the present invention on a push- or press-cap container design, suitable for a capping device where the chuck is arranged for example to push the capsule on to the container opening. A person skilled in the art also realises that the container on to which the cap is mounted is not necessarily a complete container, but alternatively only that part of the container on to which the container opening is formed, e.g. a bottle neck. The foregoing has described the principles, preferred embodiments and modes of operation of the present invention. However, the invention should not be construed as being limited to the particular embodiments discussed above. It should be appreciated that variations may be made in those embodiments by workers skilled in the art without departing from the scope of the present invention as defined by the following claims.

What is claimed is:

1. A capping mechanism, comprising a feeder device for feeding caps forward arranged top-to-bottom along a feeding axis to an outlet position said feeder device, and a chuck arranged to grip a cap from a first side of said chuck at said outlet position, and to mount said cap to a container opening at a second side of said chuck, opposite said first side along said feeding axis, wherein said feeder device comprises means for engaging diametrically about a cap present in the feeder device, and means for moving the cap forward along the feeding axis to said outlet position during engagement, wherein said chuck comprises means for engaging said cap in said outlet position.

2. The mechanism as recited in claim 1, wherein said feeder device comprises a pair of feeder jaws devised to alternately grip and release a cap present there between, and to feed the cap forward by displacing said pair of feeder jaws forward along the feeding axis during engagement.

3. The mechanism as recited in claim 2 wherein said feeder device comprises elongated feeder members movable in pairs relative to each other and arranged to alternately hold and release caps arranged between two members in a pair, thereby feeding said caps forward during a hold and move action of at least one pair of said members.

4. The mechanism as recited in claim 3, wherein said chuck has a central passage and comprises two or more adjustable chuck jaws arranged to hold the cap during a mounting act.

5. The mechanism as recited in claim 3, wherein said feeder members comprises two pairs of feeder jaws.

6. The mechanism as recited in claim 5, wherein each jaw of each pair of feeder jaws is moveable towards the other jaw, and in that one pair of jaws also is moveable in a direction parallel to the feeding axis.

7. The mechanism as recited in claim 1, wherein said feeder device comprises elongated feeder members movable in pairs relative to each other and arranged to alternately hold and release caps arranged between two members in a pair, thereby feeding said caps forward during a hold and move action of at least one pair of said members.

8. The mechanism as recited in claim 7, wherein said chuck has a central passage and comprises two or more adjustable chuck jaws arranged to hold the cap during a mounting act.

9. The mechanism as recited in claim 7, wherein said feeder members comprises two pairs of feeder jaws.

10. The mechanism as recited in claim 9, wherein each jaw of each pair of feeder jaws is moveable towards the other jaw, and in that one pair of jaws also is moveable in a direction parallel to the feeding axis.

11. The capping mechanism as recited in claim 1, wherein said feeder device comprises means for engaging about a first portion of a circumference of a cap present in the feeder device, and said chuck comprises means for engaging about a second portion, different from said first portion, of said circumference when said cap is present in said outlet position.

12. The capping mechanism as recited in claim 11, wherein said first portion covers substantially diametrically opposing areas of the circumference of the cap.

13. The capping mechanism as recited in claim 11, wherein said feeder device comprises first and second gripping jaws, devised to engage a cap in said inlet position by gripping substantially diametrically opposing areas of the circumference of the cap, and means for moving said gripping jaws along said feeding axis.

14. The capping mechanism as recited in claim 1, wherein cap supply means are devised to supply caps one by one to the inlet position of said feeder device.

15. The capping mechanism as recited in claim 14, wherein said cap supply means are devised to supply caps to the inlet position in a supply direction which has an angle to said feeding axis.

16. The capping mechanism as recited in claim 15, wherein said cap supply means are devised to supply caps to the inlet position in a supply direction which is substantially perpendicular to said feeding axis.

17. The capping mechanism as recited in claim 14, wherein said cap supply means are devised to supply caps arranged side-by-side along said supply direction to the inlet position.

18. The capping mechanism as recited in claim 14, wherein said feeder device comprises elongated feeder members movable in pairs relative to each other and arranged to alternately hold and release a cap arranged between two members in a pair, thereby feeding said cap forward during a hold and move action of at least one pair of said members.

19. The capping mechanism as recited in claim 1, wherein said feeder device is arranged to grip and move two or more caps at a time, which caps are successively supplied to said inlet position and fed top-to-bottom by said feeder members to said outlet position.

20. A method for capping containers, comprising the steps of:

supplying a cap to an inlet position of a feeder device such that said cap is arranged with a bottom of the cap facing a feeding axis;

gripping the cap by means of the feeder device engaging about a first portion of a circumference of the cap;

feeding the cap, under engagement, along said feeding axis to an outlet position;

receiving the cap from a first side of a chuck at said outlet position;

gripping the cap by said chuck; and mounting the cap to a container opening at a second side of said chuck, opposite said first side along said feeding axis.

21. The method for capping containers as recited in claim 20, wherein said steps of gripping and feeding the cap in the feeder device is executed by the steps of:

gripping said cap with a pair of feeder jaws; and displacing said pair of feeder jaws forward along the feeding axis.

22. The method for capping containers as recited in claim 20, wherein said chuck grips said cap by engaging about a second portion, different from said first portion, of said circumference.

23. The method for capping containers as recited in claim 22, wherein said first portion covers substantially diametrically opposing areas of the circumference of the cap.

24. A method for feeding caps in a container capping machine, comprising the following steps:

supplying a first and a second cap to a feeder device, wherein said caps are arranged top to bottom;

engaging the caps diametrically;

feeding the caps, under engagement, along a feeding axis until the first cap reaches an outlet position;

gripping the first cap in the outlet position with a chuck;

removing the first cap from the outlet position by said chuck; and feeding the second cap, under engagement, along the feeding axis until it reaches the outlet position.

* * * * *